US008009117B2

(12) United States Patent
Lo Forti et al.

(10) Patent No.: US 8,009,117 B2
(45) Date of Patent: Aug. 30, 2011

(54) DUAL REFLECTOR MECHANICAL POINTING LOW PROFILE ANTENNA

(75) Inventors: Raimondo Lo Forti, Rome (IT); Giancarlo Bellaveglia, Rome (IT); Luca Marcellini, Rome (IT)

(73) Assignee: Tes Teleinformatica e Sistemi S.R.L., Rome (IT)

( * ) Notice: Subject to any disclaimer, the term of this patent is extended or adjusted under 35 U.S.C. 154(b) by 347 days.

(21) Appl. No.: 12/375,591

(22) PCT Filed: Aug. 1, 2007

(86) PCT No.: PCT/IB2007/053034

§ 371 (c)(1),
(2), (4) Date: Jan. 29, 2009

(87) PCT Pub. No.: WO2008/015647

PCT Pub. Date: Feb. 7, 2008

(65) Prior Publication Data

US 2009/0322635 A1 Dec. 31, 2009

(30) Foreign Application Priority Data

Aug. 3, 2006 (IT) ..... RM2006A0418

(51) Int. Cl.
*H01Q 3/12* (2006.01)
*H01Q 3/00* (2006.01)

(52) U.S. Cl. ..... 343/761; 343/763; 343/766; 343/781 P

(58) Field of Classification Search ..... 343/781 P, 343/781 CA, 757, 758, 761, 763, 766
See application file for complete search history.

(56) References Cited

U.S. PATENT DOCUMENTS

| | | | | |
|---|---|---|---|---|
| 4,786,912 | A | 11/1988 | Brown et al. | |
| 5,309,167 | A * | 5/1994 | Cluniat et al. | 343/840 |
| 5,684,494 | A | 11/1997 | Nathrath et al. | |
| 6,043,788 | A | 3/2000 | Seavey | |
| 6,538,612 | B1 | 3/2003 | King | |
| 7,129,903 | B2 * | 10/2006 | Desargant et al. | 343/781 CA |
| 2002/0075197 | A1 | 6/2002 | Shrader | |
| 2005/0280593 | A1 | 12/2005 | Cha et al. | |

OTHER PUBLICATIONS

PCT International Search Report for PCT/IB2007/053034 filed on Aug. 1, 2007 in the name of Tes Teleinformatica E Sistemi S.R.L.
PCT Written Opinion for PCT/IB2007/053034 filed on Aug. 1, 2007 in the name of Tes Teleinformatica E Sistemi S.R.L.

* cited by examiner

*Primary Examiner* — Hoang V Nguyen
(74) *Attorney, Agent, or Firm* — Steinfl & Bruno LLP

(57) ABSTRACT

Dual reflector offset mechanical pointing low profile telecommunication antenna, to be used above all on vehicles, even high-speed ones. Its reduced physical dimensions facilitate its use, with respect to the known solutions, as it allows its connecting to the receiving system, such as a satellite, though installed on a train or on an aircraft. The invention lies within the technical field of telecommunications and the applicative field of stationary, movable antennas of reduced dimensions, and accordingly within that of telecommunications in general. The original dual reflector antenna is obtained from a second-order polynomial that configurates it in the Cartesian space XYZ.

6 Claims, 3 Drawing Sheets

DUAL REFLECTOR MECHANICAL POINTING LOW PROFILE ANTENNA

CROSS REFERENCE TO RELATED APPLICATIONS

Figure 1:
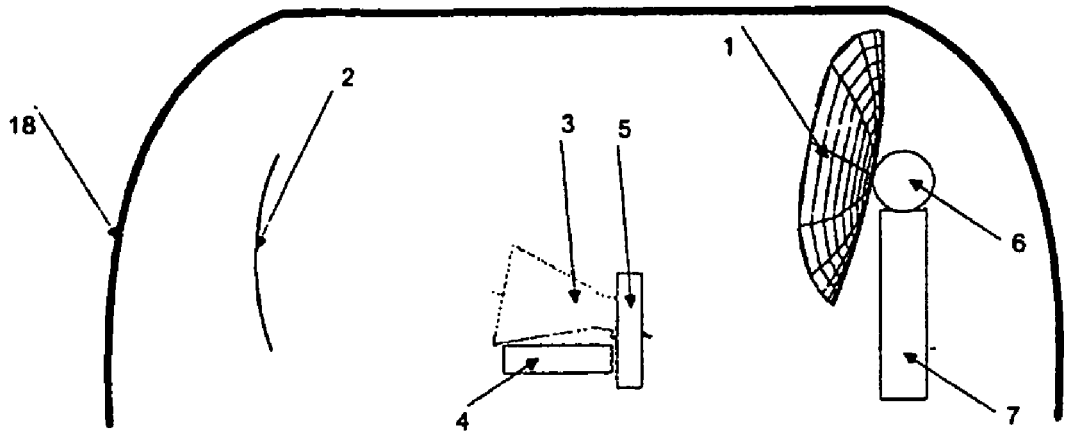

The present application is the US national stage of International Application PCT/IB2007/053034 filed on Aug. 1, 2007 which, in turn, claims priority to Italian Application RM2006A000418, filed on Aug. 3, 2006.

The invention relates to a dual reflector offset antenna for telecommunications, direct TV broadcasting and broadband multimedia applications. It is located in an outdoor unit, in turn located on a vehicle in motion. The reduced dimensions of said antenna, deriving from a suitable choice of the optical system, facilitate its use in all situations of satellite and terrestrial connections from vehicles in motion, such as trains, aircrafts, watercrafts, motor vehicles, etc. Moreover, the invention is useful in a military context, just as it is capable of transmitting and receiving even under critical conditions of connecting (linking) with the satellite and/or base stations.

The invention lies within the technical field of electronics, and accordingly of telecommunications, in particular the applicative field of movable system antennas of reduced dimensions, and accordingly within that of telecommunications in general.

The invention, in its best application, is part of an outdoor unit, along with a front end, a platform stabilized by a tracking device, a mechanical device for realigning the polarization, which may even be implemented electronically, and a DC converter.

The antenna is connected to an indoor unit for modulation and control, providing outputs for the users.

Users can link to the indoor unit by means of connection types widely used and present on the market, like e.g. LAN networks, WiFi or Bluetooth connections, etc. The antenna feed and optical system were contrived so as to ensure operation over the entire operating band, concomitantly maintaining a high pointing stability on the same band. The optics uses a corrugated horn as primary feed.

In addition to the reduced dimensions of the antenna, the solution disclosed herein allows, with ease and modularity, an increase in performances proportionally to the increase of the height dimensions. When dimensional requirements allow it, antenna performances can be improved, maintaining the utmost effectiveness between dimensions, above all the vertical one, and antenna yield.

In the solution advanced herein the sole mechanical parts in motion are the platform, the main reflector and optionally the subreflector and the mechanical device for realigning the polarization.

The configuration of the two reflecting surfaces, respectively denominated 'main reflector' ('Main') and 'subreflector' ('Sub'), allows a high angular scanning, in elevation, of the antenna beam under operating conditions. The two surfaces of said antenna configuration can be represented by a second-order polynomial, currently preferred by the Inventors, reported by the following mathematical expression:

$$A_{xx}x^2+A_{xy}xy+A_{yy}y^2+A_x x+A_y y+A_c=A_{zz}z^2+A_z z+A_{xz}xz+A_{yz}yz \quad (1)$$

The polynomial at issue describes a surface in the space referred to a Cartesian coordinate system XYZ.

The main reflector surface, described by the preceding mathematical equation (1), utilizes coefficients reported herein:

| Main reflector coefficients | | |
|---|---|---|
| Axx = 2705.988 | Ayy = 1001.998 | Azz = 0.0 |
| Axy = 0.0 | Ayz = 0.0 | Az = 2711396.0524 |
| Axz = 0.0 | Ay = 0.0 | Ac = 0.0 |
| Ax = 0.0 | | |

From the two-dimensional profile defined hereto further surface optimizations can be effected, with the aim of minimizing gain losses in beam scanning, in elevation, and of improving side lobe control.

The subreflector surface, it also described by the preceding mathematical equation (1), utilizes coefficients reported herein:

| Subreflector coefficients | | |
|---|---|---|
| Axx = 44458.341 | Ayy = −558.0232 | Azz = −43318.230 |
| Axy = 0.0 | Ayz = 0.0 | Az = −2922821.690 |
| Axz = 0.0 | Ay = 0.0 | Ac = −1876555896.680 |
| Ax = 0.0 | | |

The subreflector profile is a double-curvature one, so as to attain the utmost feeding efficiency of the main reflector, in compliance with the limits of the available dimensions.

From the two-dimensional contour defined hereto further numerical surface optimizations can be effected, with the aim of minimizing gain losses in beam scanning, in elevation, and of improving side lobe control.

The above-mentioned data are reported in order to facilitate an understanding of the invention and its originality.

Control of the interfering power transmitted to the receiving units is carried out by keeping the side lobes very low in the radiation diagram. Moreover, the antenna system is optimized to reduce overall losses due to antenna beam scanning in elevation and to the presence of the antenna-protecting cover formed by the radome. A relevant aspect of the invention is represented by the moving of the mechanical device for realigning the polarization. One of the alternatives envisaged for said realigning is represented by the rotation of the feed, by means of a motor and related gears and/or driving belts, so as to realign the electromagnetic signal polarization, subject to variations due to the geographical location and to the roll and pitch motions of the vehicle in motion.

The invention will hereinafter be described, by way of illustration and not for limitative purposes, making reference to the annexed figures.

Figure 2:
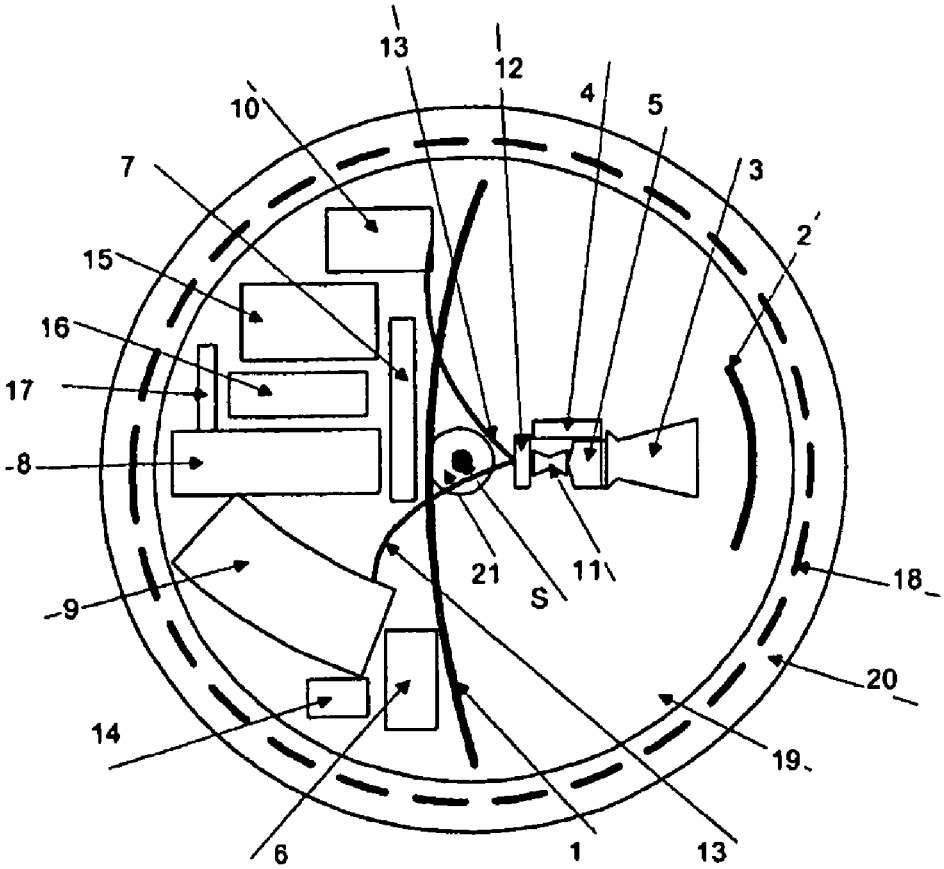
Figure 3:
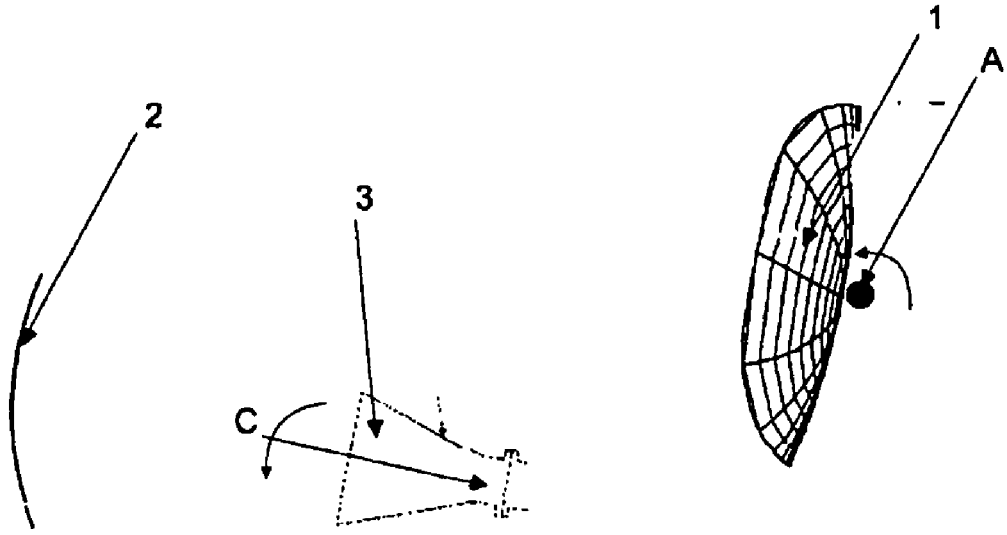
Figure 4:
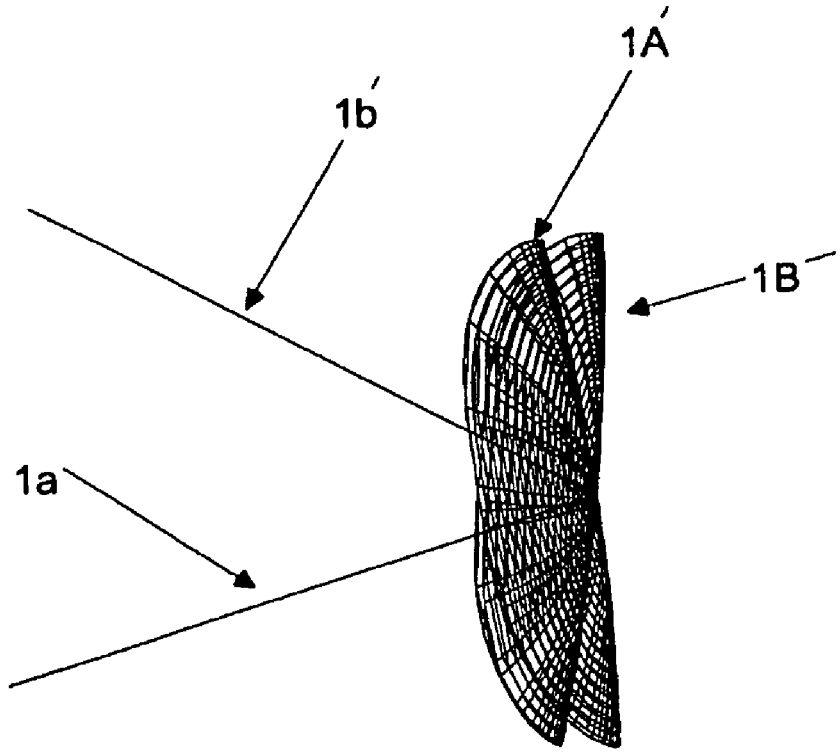
Figure 5:
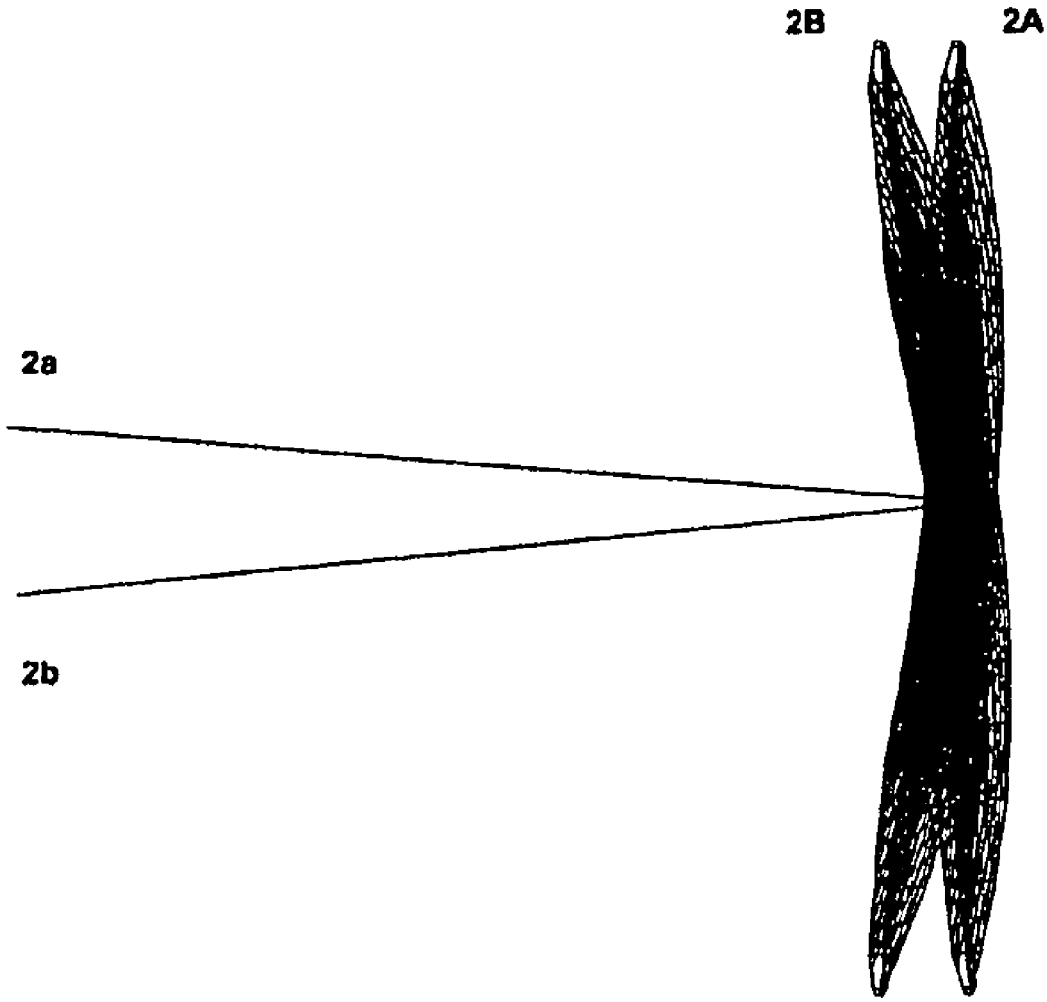

FIG. 1—Schematic depiction of the antenna;

FIG. 2—Schematic depiction of the elements contained in the outdoor unit;

FIG. 3—Schematic depiction of the motion-prone antenna parts;

FIG. 4—Schematic depiction of the rotation of the antenna main reflector;

FIG. 5—Schematic depiction of the rotation of the antenna subreflector.

Referring to FIG. 1, the antenna is comprised of the main reflector 1; the subreflector 2; the feed 3 mounted on a rotating mechanical support 5, provided with ball bearings and moved by a rotation motor 4 for realigning the polarization; a motor 6 for rotating the main reflector; the mechanical support 7 for the main reflector, positioned on ball bearings, and the radiotransparent protecting cover (Radome) 18.

The main functions of the indoor unit are reported hereinafter:

package routing from the "Ethernet/WLAN" connection (i.e., from users) to the satellite transmission system;

Encapsulation of IP packages in the satellite transport system;

Error adjustment system;

Implementation of power control and frequency control algorithms;

Monitoring and reporting for the control system of the stationary receiving-transmitting station (Hub).

In FIG. 2, showing the outdoor unit, there can be observed the main reflector 1, receiving and transmitting the electromagnetic field coming from the feed 3 and the subreflector 2; said reflector 1 is capable of rotating about axis A (FIG. 3).

The surface of the subreflector 2 was designed to optimize the feeding of the main reflector 1 on both the main planes of the antenna. The feed 3 is mounted on a mechanical support 5, provided with ball bearings, (not shown in figure) that, by a rotation motor 4, allows to realign the polarization required on any vehicle prone to roll and pitch motions. Moreover, in FIG. 2 it is shown the motor 6 for rotating the main reflector; the mechanical support 7 of the main reflector, positioned on ball bearings not shown in figure; the azimuth rotation device of the outdoor unit 8; the amplifier and the high frequency converter and transmission filter (Block Up Converter BUC) 9 available on the market; the assembly 10, comprised of Low Noise Amplifier (LNA) and receiving filter; the Ortho Mode Transducer (OMT) 11; the guide-coaxial cable transitions 12; the low-loss flexible coaxial cables 13; the Antenna Control Unit (ACU) 14; the Narrow Band Receiver (NBR) 15; the inertial measurement unit (IMU) 16; the Global Positioning System (GPS) 17); the radiotransparent protecting cover (Radome) 18; the rotary platform 19; the stationary platform 20; the rotary joint 21.

FIG. 3 shows, in particular, the configuration of the antenna in which the feed 3, the main reflector 1 and the subreflector 2 are depicted. The main reflector 1 rotates about axis A to allow a scanning of the antenna beam in the elevation plane in a range of over 30 degrees. Optionally, the subreflector 2 may rotate on the two main planes to allow a slight scanning of the subreflector-generated beam. The feed 3 rotates about axis C to carry out the realigning of the polarization.

FIG. 4 schematically shows the rotation of the main reflector. In particular, there are depicted two viable mechanical positions of the reflector: 1A and 1B, to which there correspond respectively the angular scanning 1*a* and 1*b* of the beam in elevation.

FIG. 5 schematically shows the subreflector in rotation. In particular, two viable mechanical positions of the reflector are depicted: 2A and 2B, to which there correspond respectively the scanning 2*a* and 2*b*, referring to the electromagnetic radiation of the subreflector in case of rotation in the vertical plane.

The original arrangement of the elements, shown in FIG. 2, forming the outdoor unit, allows to optimize the available space ensuring the correct functionality of the receiving-transmitting system. It should be noted that the antenna main reflector 1 is arranged with its greater dimension along the central section of the rotary platform 19. Thus, the maximum radiant opening is exploited, within the limits of available space. The devices dedicated to the transmitting, the receiving, the mechanical moving, the feeding and the tracking, are arranged at the rear of the main reflector 1 so as not to interfere, from an electromagnetic standpoint, with the radiation diagram of the antenna. Of course, the arrangement of the components and devices located behind the antenna is the one currently preferred by the Inventors.

Another relevant aspect is that related to the pointing of the antenna beam in the elevation plane. This antenna configuration ensures a nominal pointing of the beam, in the elevation plane, from which an angular scanning of over 30 degrees can be effected. The angular value of the nominal elevation pointing can be selected with extreme flexibility in order to best meet the pointing requirements deriving from the type of connection requested and the geographic position of the receiving-transmitting system, especially in satellite telecommunication connections.

Unlike other solutions, in which for the pointing of the beam in elevation the whole antenna has to be moved, this configuration allows lesser mechanical stresses, simplification in the construction, lesser physical limitations and it avoids limitations in the wiring and electrical connection of the parts in motion.

Moreover, the antenna offers the option of recovering the misalignment of the polarization of the satellite-transmitted signal, with respect to that of the antenna-received signal, by a mere mechanical rotation of the entire feed or by rotation of a polarizer.

The invention claimed is:

1. A telecommunication antenna comprising:

a main reflector;

a subreflector;

a feed mounted on a feed mechanical support, the feed mechanical support provided with ball bearings and moveable by a rotation motor for polarization realignment;

a motor for rotating the main reflector;

a main reflector mechanical support, positioned on ball bearings, and a radome, wherein the antenna is mounted on a rotary platform, the rotary platform associated with a tracking system comprising:

an azimuth rotation device;

an antenna control unit;

a narrow band receiver;

an inertial measurement unit;

a global positioning system;

a stationary platform; and a rotary joint.

2. The antenna according to claim 1, wherein the rotary joint is an element for transit of power supply cables and signals transmitted and/or received.

3. The antenna according to claim 1, wherein the main reflector is arranged with its greater dimension along a central section of the rotary platform; and devices for transmission, reception, mechanical moving, feeding and tracking are arranged at the rear of the main reflector.

4. A telecommunication antenna comprising:

a main reflector;

a subreflector;

a feed mounted on a feed mechanical support, the feed mechanical support provided with ball bearings and moveable by a rotation motor for polarization realignment;

a motor for rotating the main reflector;

a main reflector mechanical support, positioned on ball bearings, and a radome, wherein the antenna is provided with a front end receiving-transmitting device comprising:

an amplifier—block-up converter assembly;

a low noise amplifier—receiving filter assembly;

a transducer;

guide-coaxial cable transitions; and low-loss flexible coaxial cables.

5. A telecommunication antenna comprising:

a main reflector;

a subreflector;

a feed mounted on a feed mechanical support, the feed mechanical support provided with ball bearings and moveable by a rotation motor for polarization realignment;

a motor for rotating the main reflector;

a main reflector mechanical support, positioned on ball bearings, and a radome, wherein the main reflector and the subreflector comprise reflector surfaces, the reflector surfaces being obtained from a second-order polynomial $$A_{xx}x^2+A_{xy}xy+A_{yy}y^2+A_xx+A_yy+Ac=A_{zz}z^2+A_zz+A_{xz}xz+A_{yz}yz$$

wherein the second-order polynomial describes a surface in space referred to a Cartesian coordinate system XYZ.

6. The antenna according to claim 5, wherein second-order polynomial coefficients for the main reflector are:

$A_{xx}$=2705.988

$A_{yy}$=1001.998

$A_{zz}$=0.0

$A_{xy}$=0.0

$A_{yz}$=0.0

$A_z$=2711396.0524

$A_{xz}$=0.0

$A_y$=0.0

$A_c$=0.0 and wherein second-order polynomial coefficients for the subreflector are:

$A_{xx}$=44458.341

$A_{yy}$=−558.0232

$A_{zz}$=−43318.230

$A_{xy}$=0.0

$A_{yz}$=0.0

$A_z$=−2922821.690

$A_{xz}$=0.0

$A_y$=0.0

$A_c$=−1876555896.680.

* * * * *